United States Patent [19]

Creim

[11] 4,166,447

[45] Sep. 4, 1979

[54] DECORATIVE FIREPLACE STANDARD FOR LOG GRATE

[75] Inventor: James M. Creim, Nashville, Tenn.

[73] Assignee: Cumberland Valley Metals, Inc., Nashville, Tenn.

[21] Appl. No.: 859,380

[22] Filed: Dec. 12, 1977

[51] Int. Cl.[2] ..... F24B 13/00

[52] U.S. Cl. ..... 126/298; 126/165; 403/182; 403/296; D7/211; D23/96

[58] Field of Search ..... 126/164, 165, 298; D7/207, 211; D23/94, 95, 96, 97; 403/182, 183, 184, 296

[56] References Cited

U.S. PATENT DOCUMENTS

| | | | |
|---|---|---|---|
| D. 242,544 | 11/1976 | Betenbaugh, Jr. | D23/96 |
| 938,723 | 11/1909 | Swan | 403/182 |
| 1,347,935 | 7/1920 | Campbell | D7/211 |
| 2,274,920 | 3/1942 | Covert | 126/298 |
| 2,390,453 | 12/1945 | Murdock | D7/211 |
| 2,447,295 | 8/1948 | Waggoner | 126/298 |
| 2,543,230 | 2/1951 | Dart | 126/298 |
| 3,613,660 | 10/1971 | Wilkinson | 126/298 |

*Primary Examiner*—Ronald C. Capossela
*Attorney, Agent, or Firm*—Harrington A. Lackey

[57] ABSTRACT

A fireplace standard assembly including a decorative fireplace standard, a sleeve connector member connected to the rear surface of the fireplace standard and adapted to receive one of the front upright grate bar members of a log grate to resemble an andiron.

5 Claims, 4 Drawing Figures

10
11
12
13
14
15
16
16'
17
20
21
22
24
26
27
28
29
30
32
2
4

DECORATIVE FIREPLACE STANDARD FOR LOG GRATE

BACKGROUND OF THE INVENTION

This invention relates to fireplace accessories, and more particularly to a decorative fireplace standard for attachment to a log grate to resemble an andiron.

Decorative andirons, employed in pairs, and each having a front upright decorative standard and a rearwardly extending log-supporting bar, are well-known in the art.

Log grates for supporting logs within a fireplace, without any decorative elements, are also known in the art. One cradle-type log grate has a plurality of longitudinally spaced log-supporting bars extending front-to-rear, with one or more of the grate bars extending upward in front to prevent the logs from rolling or falling forward off the log grate.

However, it is not practical or feasible to employ andirons and a log grate in the same fireplace, in order to obtain the functional advantages of the log grate and the decorative appearance of the andirons.

SUMMARY OF THE INVENTION

It is therefore an object of this invention to provide a decorative fireplace standard assembly adapted to be attached, preferably in pairs, to the front upright portions of the grate bars in a conventional log grate in order to combine the functional advantages of the log grate and the decorative appearance of the andirons.

The decorative fireplace standards are structurally similar to andirons without the rearward extending log-supporting bars. The decorative standards may be formed and shaped to have numerous different appearances to resemble the front upright portions of conventional andirons.

Each decorative fireplace standard is provided with a connector member attached to its rear surface and adapted to be connected, and preferably detachably connected, to one of the upright members, or upright extensions of the grate bars, of a conventional log grate. In a preferred form of the invention, the connector comprises a sleeve secured to the rear surface of each decorative standard and adapted to be slip-fitted over, and telescopingly receive, the free end of the front extension grate bar in operative position, with each decorative standard resting upon the hearth in front of the log grate.

In a preferred form of the invention, the connector members may be easily released from the front extension grate bars by lifting the standard assembly. The fireplace standard assemblies are then removed from the vicinity of the fireplace while logs are burning upon the log grate in order to preserve the appearance of the decorative standards. After the fire is out, the connectors of the standard assemblies may be re-fitted over the front extension grate bars to present an attractive and decorative appearance for the log grate, when not in use supporting burning logs.

DESCRIPTION OF THE PREFERRED EMBODIMENT

Figures 1, 2, 3, 4:
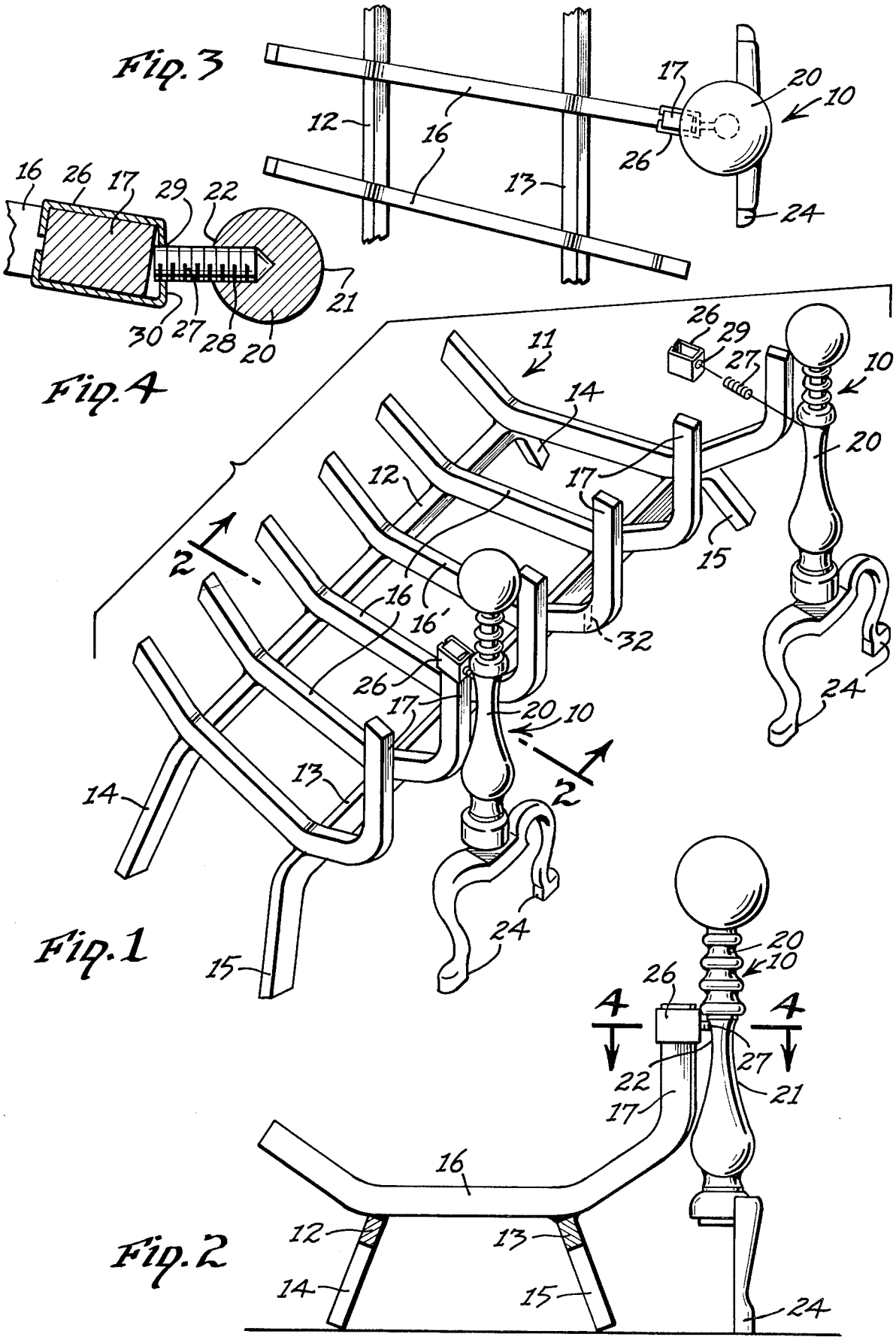
FIG. 1 is a top, front perspective view of a conventional log grate having upright front extension grate bars, with one decorative fireplace standard assembly attached in operative position upon one of the extension bars, and an exploded view of a second decorative fireplace standard assembly detached from an extension grate bar.
FIG. 2 is an enlarged section taken along the line 2—2 of FIG. 1.
FIG. 3 is a fragmentary top plan view of the log grate and assembled fireplace standard assembly disclosed in FIG. 2.
FIG. 4 is an enlarged, fragmentary section taken along the line 4—4 of FIG. 2.

Referring now to the drawings in more detail, the decorative fireplace standard assembly 10 made in accordance with this invention is adapted to be fitted upon a conventional log grate 11 constructed of rectangular sectional iron bars to resemble a cradle for supporting the logs within a fireplace. The log grate 11 includes a pair of longitudinal support bars 12 and 13 terminating in legs 14 and 15 and supporting in longitudinal spaced relationship a plurality of transverse log-supporting bars 16, 16' having substantially upright front extension grate bars 17.

Each standard assembly 10 includes a decorative standard 20 having a front surface 21 and a rear surface 22, at least the front surface 21 having a decorative appearance. The standard 20 also includes a base, disclosed in the drawings in the form of a pair of legs or feet 24 adapted to rest upon the hearth of the fireplace, when supported in its upright operative position.

Connected to the upper portion of the rear surface 22 of the standard 20 is a connector member in the form of a substantially rectangular sleeve or sleeve member 26 having an open cross-section of a size and shape adapted to slip over and receive one of the upright grate extension bars 17, as best disclosed in FIGS. 1, 2 and 4. The sleeve member 26 is connected to the standard 20 by an elongated stem 27 which is externally threaded, at least at its opposite end portions, but is disclosed in the drawings as being externally threaded throughout its length.

The front end portion of the stem 27 threadedly engages a tapped aperture 28 formed in the rear surface of the standard 20.

The threaded rear end portion of the stem 27 threadedly engages and extends through an internally threaded aperture 29 in the front wall 30 of the sleeve member 26, to engage or abut, in set-screw fashion, the front surface of the upright extension bar 17, as best disclosed in FIG. 4.

It will be noted that the front wall 30 of the sleeve member 26 is disposed at an angle to the longitudinal axis of the sleeve member. The purpose of this angular disposition of the front end wall 30 is to dispose the threaded stem 27 in a true front-to-rear direction, so that the planes of the standards 20, or more particularly the planes of the feet 24, will be substantially coplanar, extending truly transversely of the fireplace. The angularity of the front end wall 30 of the sleeve 26 is necessitated because the particular cross bars 16 and their extension bars 17 upon which the sleeve members 26 fit, diverge at angles to the front-to-rear median line of the log grate 11. The diverging angles of some of the transverse log bars 16 are best disclosed in FIG. 3. Since the transverse bars 16 diverge in opposite directions from, but at equal angles to, the front-to-rear median of the log grate 11, the sleeve 26 disclosed as a part of the left decorative standard assembly 10 is merely turned upside-down for use as the connector member on the right standard assembly 10.

In using the combination of the decorative fireplace standard assembly 10 and the log grate 11, the log grate 11 is first inserted into the interior of the fireplace with the extension bars 17 in front. The threaded stem 27 is then screwed into the mating aperture 28 of the standard 20 to the desired depth. The internally threaded aperture 29 of the sleeve 26 is aligned with the opposite end of the threaded stem 27, and the sleeve 26 is rotated to screw its front end wall 30 upon the rear end portion of the stem 27. The sleeve 26 is rotated only about three turns until the rear end of the stem 27 barely protrudes behind the front end wall 30. The entire standard assembly 10 is then raised slightly until the sleeve 26 is aligned with the upper end of the front extension bar 17. The sleeve member 26 is then lowered to slip down over the front extension bar 17, until the feet 24 rest upon the hearth. If the sleeve member 26 and the rear end of the stem 27 fit too loosely around the front extension bar 17, then the standard 20 may be lifted, the sleeve 26 rotated an additional appropriate number of turns and the sleeve again lowered to fit over the free end of the front extension bar 17, until the desired fit is attained.

The above operation is repeated for a second fireplace standard assembly 10 to fit upon an upright front extension bar 17 toward the other end of log grate 11, so that both standard assemblies 10 are symmetrical about a front-to-rear median line of the log grate 11.

Both decorative standard assemblies 10, as supported upon a pair of front extension bars 17 give the log grate 11 a much more attractive appearance than the log grate 11 by itself, and give the impression that a pair of andirons are disposed through, or in combination with, the log grate 11.

However, when it is desired to ignite logs supported upon the log grate 11, it is advantageous to lift both standard assemblies 10 causing the sleeves 26 to slide upward and off the corresponding extension bars 17. When completely detached, the standard assemblies 10 are then removed from the vicinity of the fireplace so they will not be exposed to the smoke and heat, which may tarnish, discolor or otherwise damage the surface or appearance of the standards 20.

After the fire has been extinguished, the standard assemblies 10 are re-attached to the corresponding upright extension bars 17.

The standard assemblies 10 function to give the appearance of a pair of andirons in the fireplace in combination with the additional function of a strong support for the logs upon the log grate 11.

Although the log grate 11 is disclosed in FIG. 1 as having all of its transverse log-supporting bars 16 projecting upward to form front extension bars 17 of substantially uniform height, nevertheless the log grate 11 could have cross bars such as 16', terminating in a front end 32 illustrated in dotted lines in FIG. 1, so long as two upright extension bars 17 remain for reception of the sleeves 26 of a pair of decorative fireplace standard assemblies 10.

What is claimed is:

1. A decorative fireplace standard assembly for attachment to a log grate having at least one, substantially vertical, front, upright member of substantially uniform cross-section and having a free upper end, comprising:

(a) a decorative upright standard having front and rear surfaces, and a base adapted to rest on the hearth of a fireplace, (b) a sleeve member having a front adapted to coaxially receive the front upright member, (c) a connector stem having opposite end portions connected respectively to the rear surface of said standard and the front of said sleeve member, to support said standard in an upright operative position upon the hearth in front of said log grate.

2. The invention according to claim 1 in which at least the end portions of said stem are externally threaded, a mating aperture in the rear surface of said standard threadedly receiving one threaded end portion of said stem, an internally threaded aperture through the front of said sleeve member threadedly receiving the other threaded end portion of said stem.

3. The invention according to claim 1 in which the front upright member is a bar having a rectangular cross-section and said sleeve member has a substantially complementary rectangular open cross-section for receiving said front upright member in operative position.

4. The invention according to claim 3 in which said sleeve member has a front end wall and opposed parallel side walls, said front end wall being disposed at an angle to said side walls to project said stem truly forward from the log grate.

5. The invention according to claim 1 in which said sleeve member has a vertically split wall portion to facilitate reception of front upright members of slightly varying sizes.

* * * * *